US007681866B2

(12) United States Patent
Lehmann

(10) Patent No.: US 7,681,866 B2
(45) Date of Patent: Mar. 23, 2010

(54) ARTICULATED RAIL MOUNT

(76) Inventor: Ryan Lehmann, 1401 Vermont Ave., Lancaster, PA (US) 17603

( * ) Notice: Subject to any disclaimer, the term of this patent is extended or adjusted under 35 U.S.C. 154(b) by 363 days.

(21) Appl. No.: 11/559,498

(22) Filed: Nov. 14, 2006

(65) Prior Publication Data

US 2007/0145343 A1 Jun. 28, 2007

Related U.S. Application Data

(60) Provisional application No. 60/750,108, filed on Dec. 14, 2005.

(51) Int. Cl.
*E04H 17/14* (2006.01)
*F16D 3/00* (2006.01)

(52) U.S. Cl. ..... 256/67; 403/57; 403/58; 256/65.01

(58) Field of Classification Search ..... 403/57, 403/58; 256/67, 65.01
See application file for complete search history.

(56) References Cited

U.S. PATENT DOCUMENTS 5,943,919 A * 8/1999 Babinski ..... 403/57
6,890,120 B2 * 5/2005 Hozie ..... 403/57
2003/0193049 A1 * 10/2003 Kim ..... 256/67

* cited by examiner

*Primary Examiner*—Victor MacArthur
(74) *Attorney, Agent, or Firm*—McNees Wallace & Nurick, LLC

(57) ABSTRACT

A fencing connector and fencing system utilizing fencing connectors. The fencing connectors include a swivel mount having a cavity configured to receive a first swivel assembly. The first swivel assembly is rotatable about a first axis within the swivel mount. A second swivel assembly is rotatably attached to the first swivel assembly. The second swivel assembly is rotatable about a second axis. The second swivel assembly further having a pocket configured to receive a structural member.

12 Claims, 7 Drawing Sheets

ARTICULATED RAIL MOUNT

FIELD OF THE INVENTION

The present invention is directed to fencing, railing, and/or decking components and fencing, railing, and decking systems. More particularly, the invention is directed to rail mounts that fasten structural members to fencing, railing, and/or decking members.

BACKGROUND OF THE INVENTION

Vinyl or plastic products are known for constructing, for example, decks, fences for yards and/or railings for use on staircases. Vinyl and plastic fencing is aesthetically pleasing and easy to maintain, but requires assembly of various, typically prefabricated, fence components by an installer. Connection of the fence rails to the vertically extending fence posts is difficult due to the fact that the components need to be aligned and connected together. Installation becomes more difficult on uneven surfaces, staircases or on railing spanning multiple levels because the railing requires attachment at various angles that may be non-uniform and/or may require custom sized components.

What is needed is an inexpensive mounting structure that is capable of providing easy and reliable installation of fence rails at various angles between posts.

SUMMARY OF THE INVENTION

The present invention is directed to a fencing connector and a fencing system utilizing a fencing connector having at least two independent axes of rotation, permitting a large range of motion that is connectable to fencing components, including structural members and fencing components arranged at angles to each other.

A first aspect of the present invention is a fencing connector having a swivel mount having a cavity configured to receive a first swivel assembly. The first swivel assembly is rotatable about a first axis within the swivel mount. A second swivel assembly is rotatably attached to the first swivel assembly. The second swivel assembly is rotatable about a second axis. The second swivel assembly further has a pocket configured to receive a structural member.

A second aspect of the present invention includes a fencing system having a fencing connector connected to a fencing member. The fencing connector has a swivel mount having a cavity configured to receive a first swivel assembly. The first swivel assembly is rotatable about a first axis within the swivel mount. A second swivel assembly is rotatably attached to the first swivel assembly. The second swivel assembly is rotatable about a second axis. The second swivel assembly further has a pocket configured to receive a structural member.

An advantage of an embodiment of the present invention is that the rail mount allows articulation about two axes, providing a large range of pivoting that permits attachment of structural members at a variety of angles.

Another advantage of an embodiment of the present invention is that the rail mount may be utilized with a variety of structural members, including structural members of various cross-sectional geometries.

Still another advantage of an embodiment of the present invention is that the rail mount may be easily installed and may be installed into existing fencing systems.

Still another advantage of an embodiment of the present invention is that the rail mount may be utilized in stairs and fencing systems having elevation changes.

Still another advantage of an embodiment of the present invention is that the rail mount may be utilized in areas requiring aesthetically pleasing junctions.

Still anther advantage of an embodiment of the present invention is that the rail mount provides flexibility in installation, providing greater tolerance for errors in cutting, fitting and installing fencing components.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
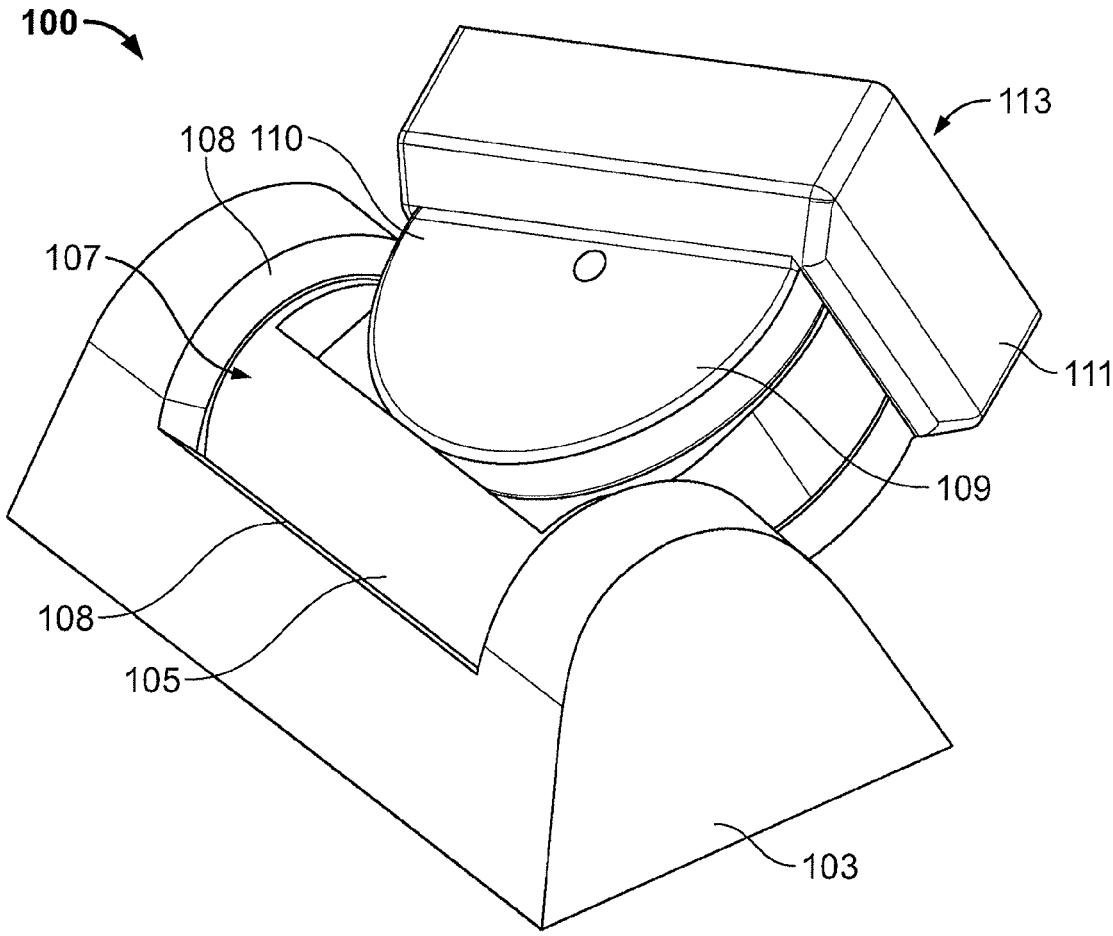
FIGS. 1 and 2 show perspective views of a rail mount according to an embodiment of the present invention.
Figure 2:
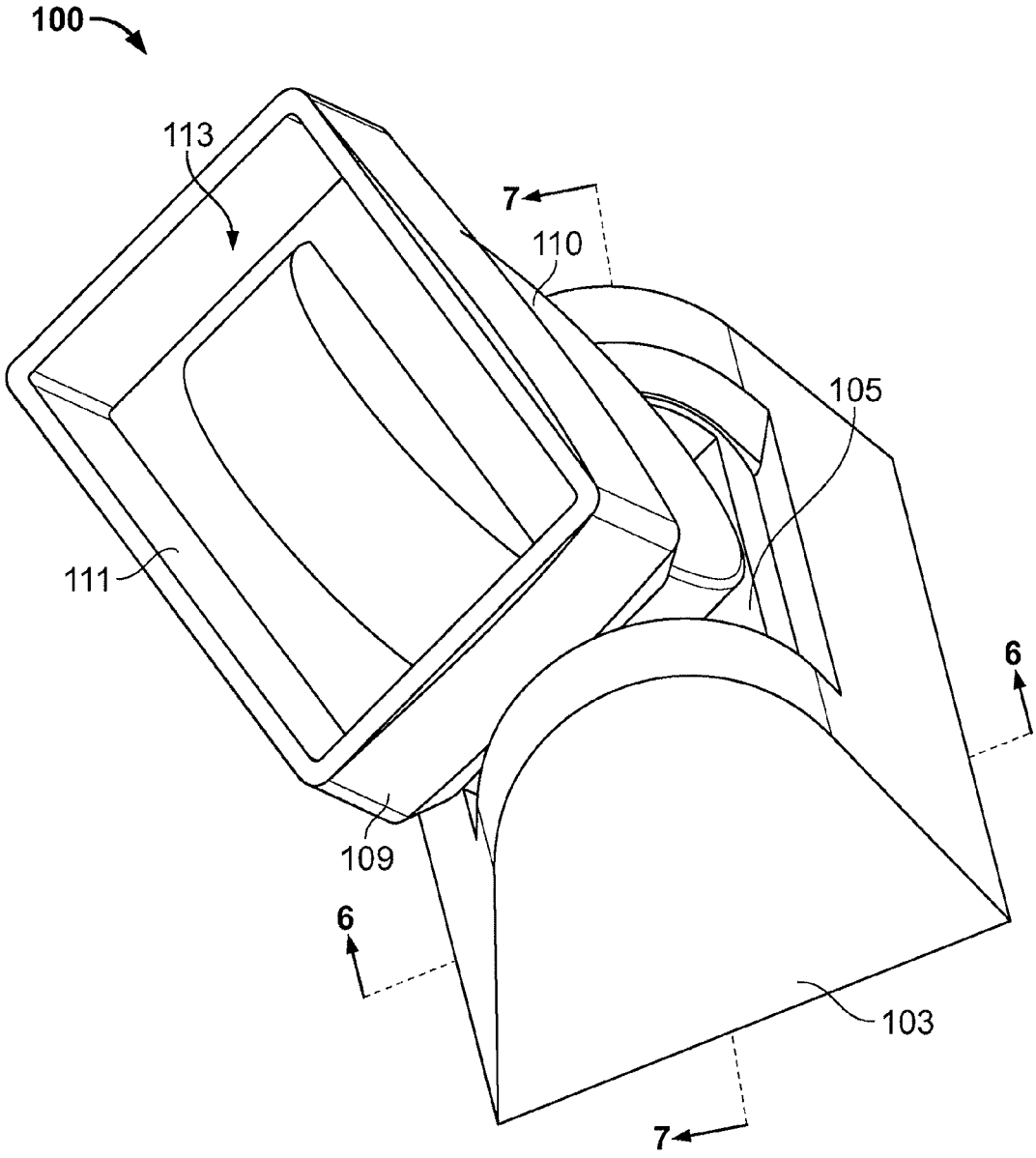

FIGS. 1 and 2 show a rail mount 100 according to an embodiment of the present invention. The rail mount 100 includes a base or swivel mount 103. The swivel mount 103 is preferably configured to be attachable to a fence, fencing component or other structure. Suitable attachment may include, but is not limited to screws, nails, adhesive or incorporation of interlocking features into the swivel mount 103 and the object onto which the swivel mount is to be attached. A first swivel assembly 105 is rotatably mounted within the swivel mount 103. Swivel mount 103 includes an opening 107 through which the first swivel assembly 105 may attach to second swivel assembly 109. Opening 107 further includes stop surfaces 108, which provide surfaces defining the extent to which the first swivel assembly 105 and the second swivel assembly 109 may pivot. Opening 107 may be configured to provide a desirable range of rotation between the first swivel assembly 105 and the second swivel assembly 109. Second swivel assembly 109 includes a swivel portion 110 and a cap portion 111. The swivel portion 110 pivotably attached to the first swivel assembly 105 by a pin, rivet, bolt, screw, rod or other device capable of pivotably attaching the first swivel assembly 105 to the second swivel assembly 109. However, the swivel portion 110 may attach in any manner that permits pivoting rotation with respect to the first swivel assembly 105. Cap portion 111, includes a pocket 113 configured to mate a structural member 800 (see, e.g., FIGS. 8 and 9) such as fencing, railing, or other component. Pocket 113 may be configured into any suitable geometry for mating the corresponding structural members 800. Suitable geometries include a pocket 113 configured to receive structural members 800 having cross-sections including, but not limited to, rectangular cross-sections, triangular cross-sections, square cross-sections, oval or circular cross-sections, mushroom or bread-bun cross-sections, and "T" rail cross-sections. In particular, the pocket 113 receives structural members 800 having geometries desirable for use in fencing systems. The structural members 800 are preferably attached to the pocket 113 in a known manner for attaching fencing components together, including but not limited to, adhering, screwing, bolting, mechanically locking or frictionally engaging the structural member 800 into pocket 113. Pocket 113 preferably has a sufficient depth to allow attachment and to provide masking of imperfections in the cutting and/or finishing of the ends of the structural member 800.

Figure 3:
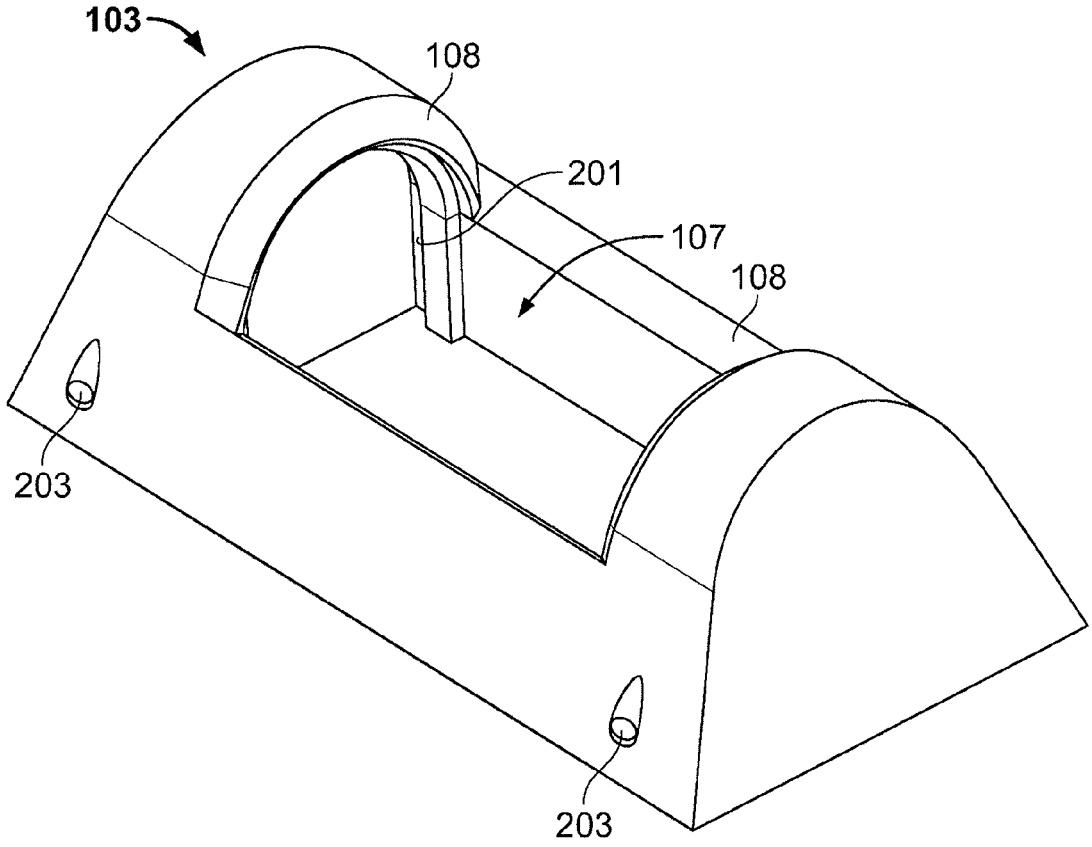
FIG. 3 shows a perspective view of a swivel mount according to an embodiment of the present invention.

FIG. 3 shows a swivel mount 103 having opening 107. As shown, stop surfaces 108 extend along the periphery of opening 107 and provide a surface onto which the first swivel assembly 105 and the second swivel assembly 109 may engage to define the limits of the pivoting motion. The stop surfaces 108 may be tapered or perpendicular to the engaging surfaces of the first swivel assembly 105 and/or the second swivel assembly 109. In a preferred embodiment of the present invention, the swivel mount 103 is preferably hollow with an opening extending in a direction substantially opposite the opening 107 configured to permit insertion of the first swivel assembly 105. Upon insertion of first swivel assembly 105 into swivel mount 103, the swivel mount 105 may be attached to a structural member 800 or other device. When attached, the structural member 800 or other device substantially prevents first swivel assembly 105 from disengaging from swivel mount 103. Alternatively, a cover or flap (not shown) may be utilized to retain the first swivel assembly 105 in position. While not required, fastener openings 203 provide openings through which fasteners may be inserted to affix the rail mount 100 to a structure, such as a fencing member 805 (see, e.g., FIGS. 8 and 9). Swivel mount 103 preferably includes a channel 201 configured to engage feature 301 (see e.g., FIG. 4) of the first swivel assembly 105. The swivel mount 103 may include one or a plurality of channels 201 wherein the channels 201 may be disposed along any surface of swivel mount 103 that permits engagement of features 301 of first swivel assembly 105. The engagement of the channel 201 with feature 301 provides retention of first swivel assembly 105 within swivel mount 103 and permits pivoting rotation within swivel mount 103.

Figure 4:
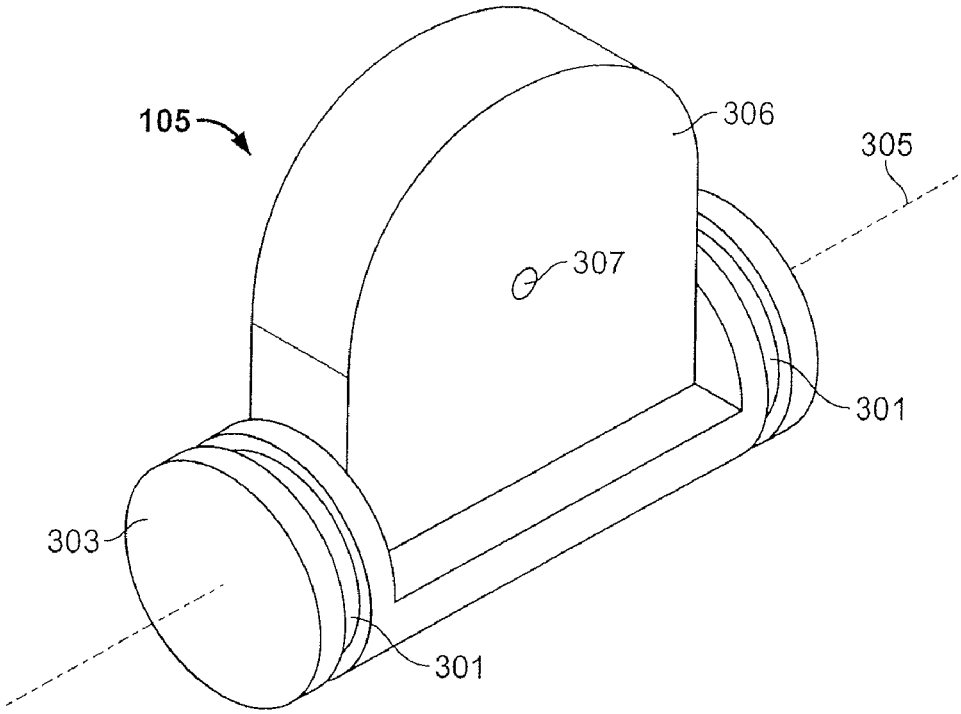
FIG. 4 shows a perspective view of a first swivel assembly according to an embodiment of the present invention.

FIG. 4 shows a first swivel assembly 105 according to an embodiment of the present invention. The first swivel assembly 105 includes a barrel portion 303 configured to rotate about a barrel center axis 305 when engaged with swivel mount 103. An attachment flange 306 extends from barrel portion 303 and is configured to attach to second swivel assembly 109. The attachment flange 306 includes an aperture 307 extending through attachment flange 306, permitting insertion of a pivoting member, such as a pin, bolt, screw, rivet, rod or other device through which second swivel assembly 107 may be pivotably attached. Attachment flange 306 preferably includes a rounded geometry permitting a large range of rotation for second swivel assembly 109 about swivel axis 501 (see, e.g., FIG. 5) when attached to first swivel assembly 105.

Figure 5:
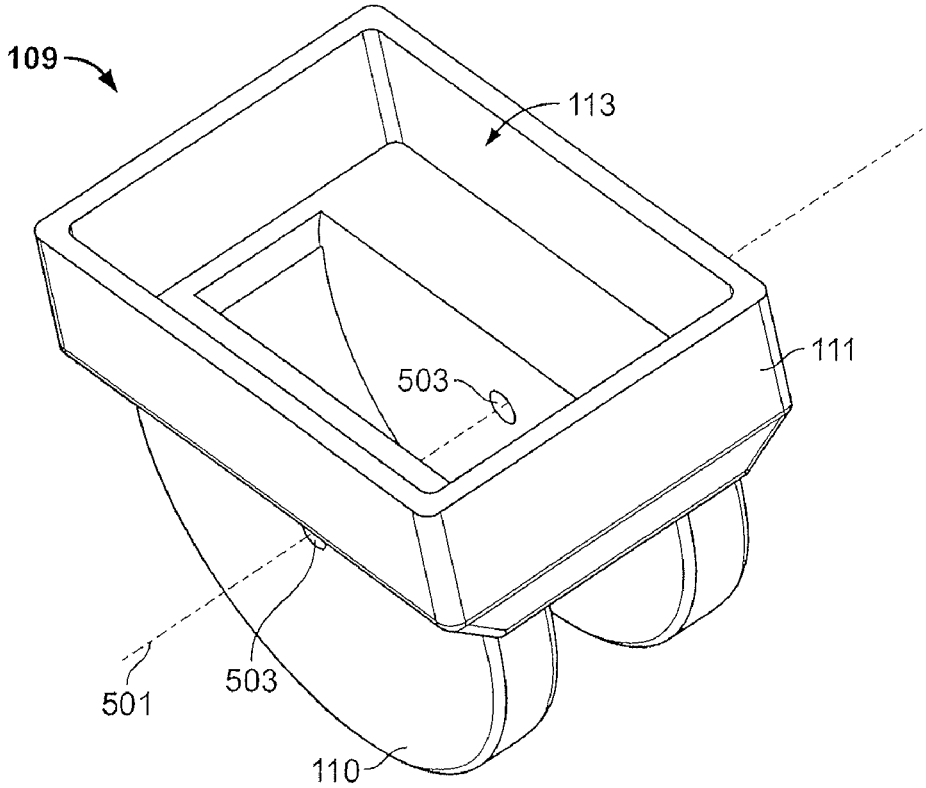
FIG. 5 show perspective views of a second swivel assembly according to an embodiment of the present invention.

FIG. 5 shows a second swivel assembly 109 according to an embodiment of the present invention. The second swivel assembly includes a swivel portion 110 having aperture 503 for receiving the pivoting member, as discussed above. Swivel portion 110 preferably includes a rounded geometry permitting a large range of rotation for second swivel assembly 109 about swivel axis 501 when attached to first swivel assembly 105.

Figure 6:
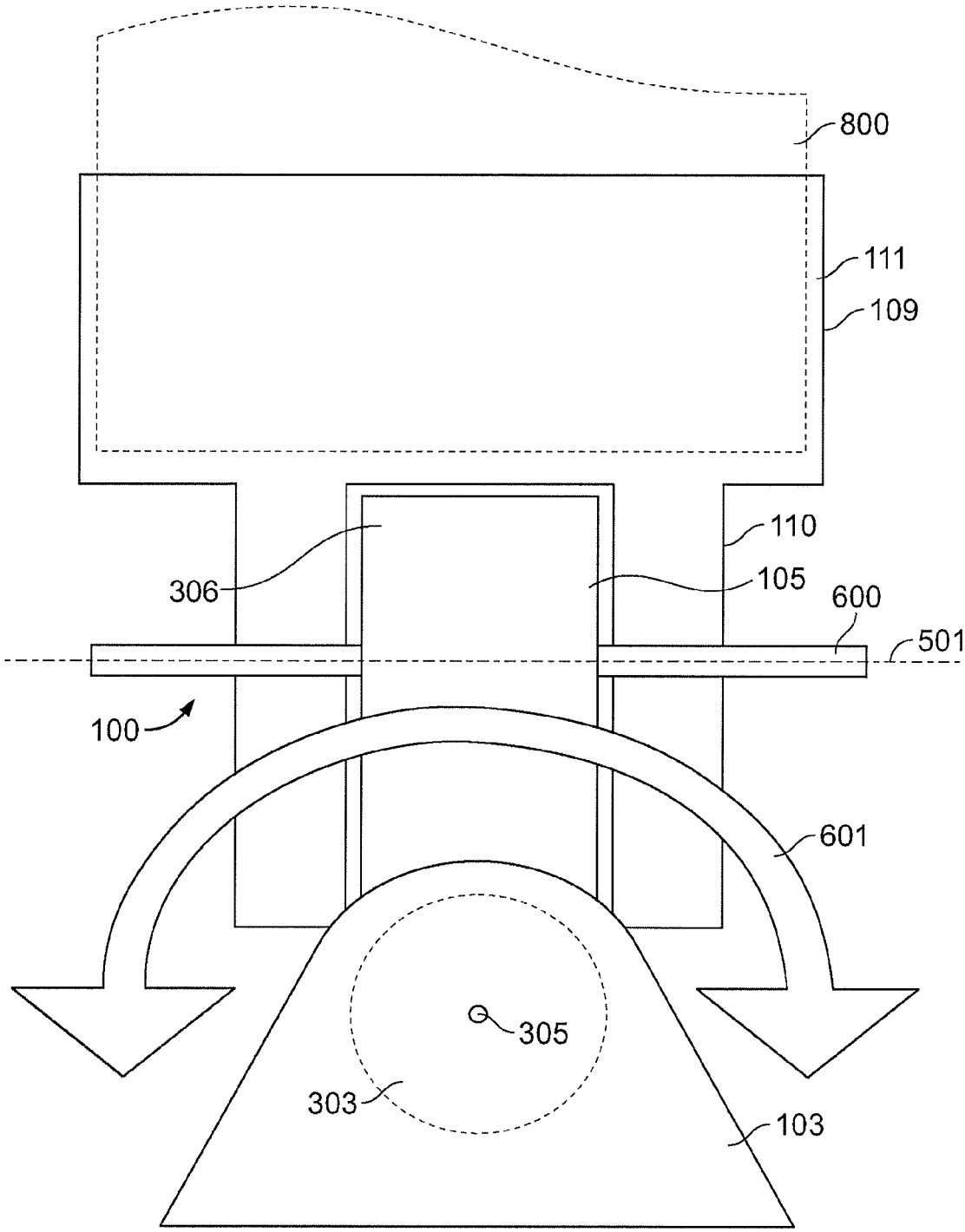
FIGS. 6 and 7 show orthogonal elevational cross-sectional views of a second swivel assembly according to an embodiment of the present invention.

FIG. 6 shows a cross-sectional view taken along line 6-6 of FIG. 2. FIG. 6 shows first swivel assembly 105 pivotably mounted in swivel mount 103. Second swivel assembly 109 is pivotably attached to the first swivel assembly 105 by insertion of pivoting member 600 through both the attachment flange 306 of first swivel assembly 105 and the swivel portion 110 of second swivel assembly 109. As shown in FIG. 6, the pivotable attachment of the first swivel assembly 105 and the second swivel assembly 109 permits rotation about axis 305 along direction 601. In addition, the first swivel assembly 105 and the second swivel assembly 109 are pivotably attached for rotation about swivel axis 501.

Figure 7:
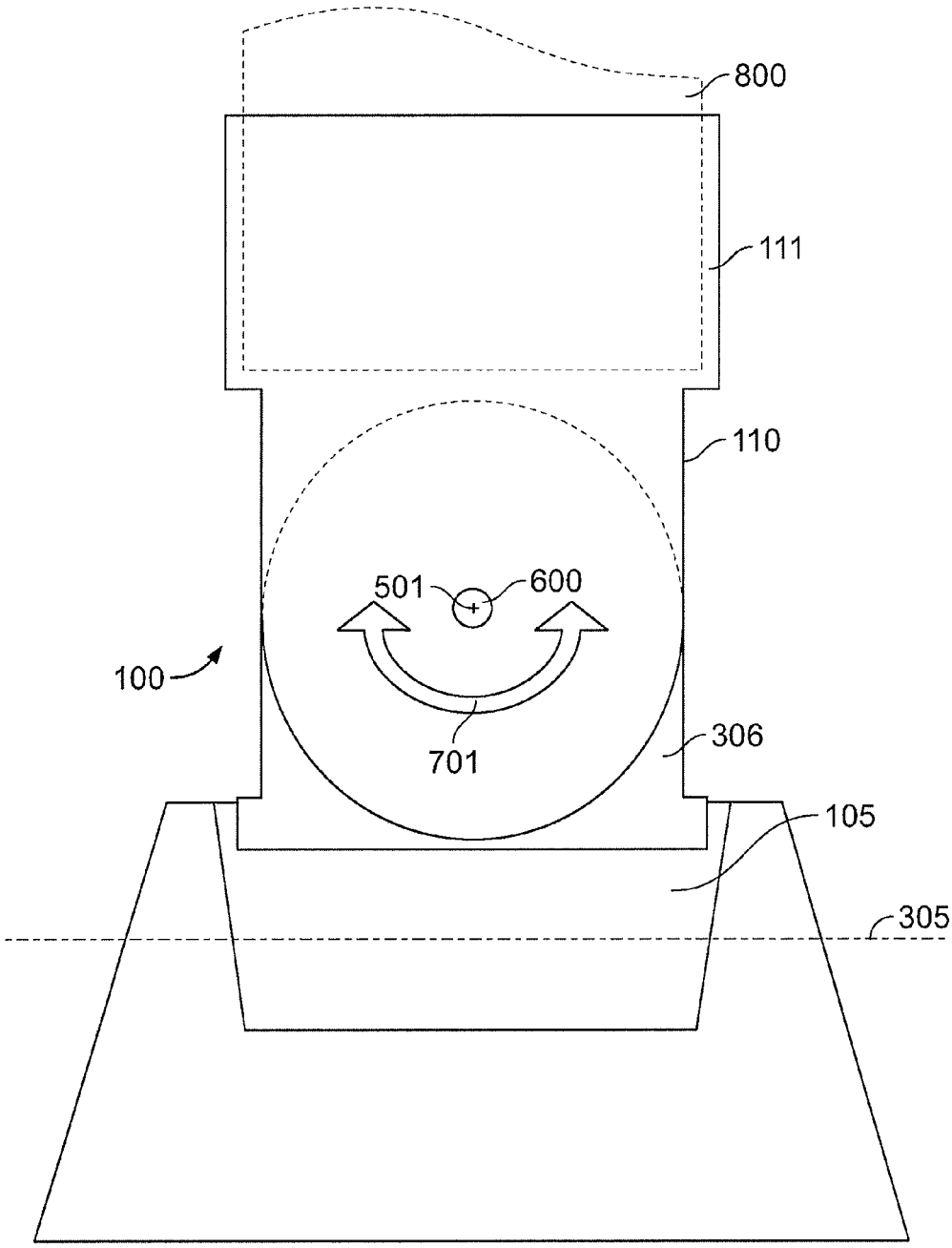

FIG. 7 shows a cross-sectional taken along line 7-7 of FIG. 2. As shown in FIG. 7, the first swivel assembly 105 and the second swivel assembly 109 are pivotably attached wherein the second swivel assembly 109 pivots about swivel axis 501 along direction 701. The rail mount 100 according to the present invention preferably permits rotation about both axes 305 and 501. The rotation about these two axes 305 and 501 permit articulation of the rail mount 100 over a large range of positions and angles, wherein the angles permit connection of structural members 800 at angles which are angles other than perpendicular, in addition to structural members 800 aligned perpendicularly. This articulation (i.e., pivoting about two independent axes) permits the installation of structural members 800 on fencing systems that do not have perfect alignment due to imperfect installation, uneven terrain, moving components and/or any other factors to contribute to misalignment of structural members 800 of fencing systems.

Figure 8:
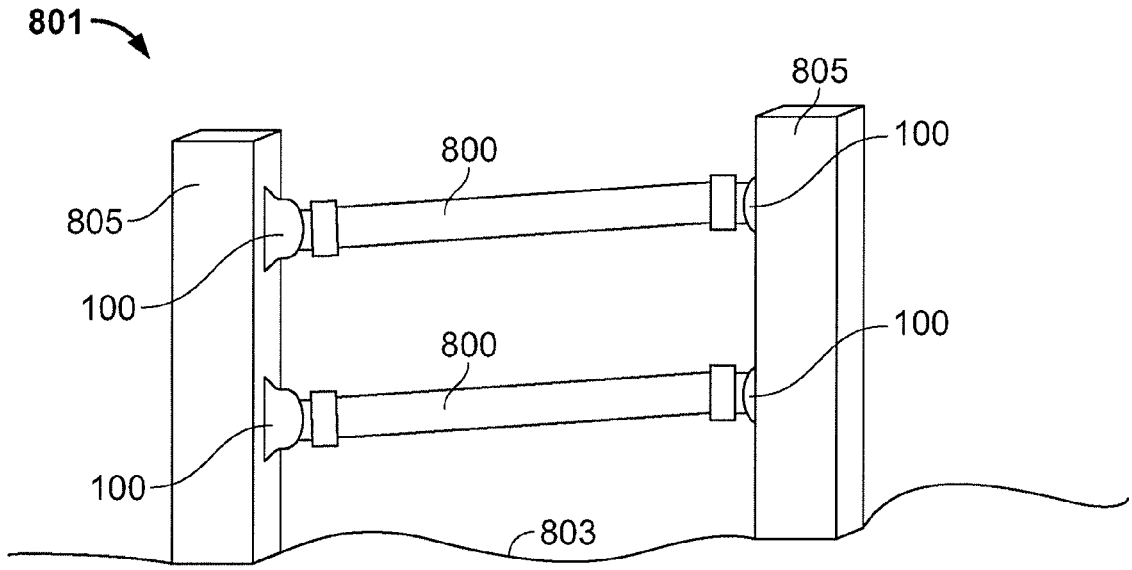
FIGS. 8 and 9 show a fencing system including the rail mount according to the present invention.

FIG. 8 shows a fencing system 801 according to an embodiment of the present invention, wherein the fencing system 801 is installed on uneven terrain 803. Two structural members 800 are installed between fencing members 805. Fencing members 805 may be posts, poles, decking members, rails or any other building product or building facade that requires a structural member 800 to be joined thereto. The fencing members are not limited to components relating to fencing and may include decking, railing and/or construction components requiring installation of structural members and angles to each other. The fencing members 805 may be fabricated from any suitable fencing material, including but not limited to wood, vinyl, composite, metal or any other conventional fencing material. The structural members 800 are attached to rail mounts 100, which are attached to fencing members 805, forming a junction therebetween. The articulation of the rail mount 100 permits attachment of the structural member 800 at a variety of angles, including the angle provided by uneven terrain 803.

Figure 9:
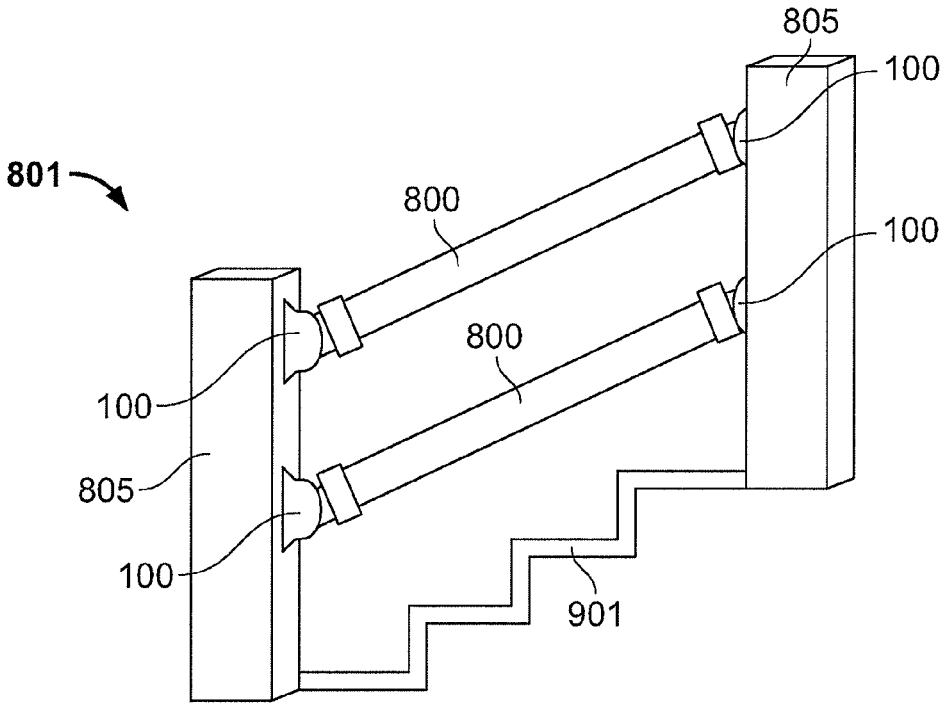

FIG. 9 shows a fencing system 801 according to another embodiment of the present invention, wherein the fencing system 801 is installed on stairs 901. Two structural members 800 are installed between fencing members 805 and form a rail, particularly for use by pedestrians climbing a stairway or stairs 901. The structural member 800 is attached to rail mounts 100, which are attached to fencing members 805. The articulation of the rail mount 100 permits attachment of the structural member 800 at a variety of angles, including the angle provided by the fencing member 805 located at different elevations.

Although FIGS. 8 and 9 illustrate elevational differences in the mounting locations of rail mounts 100, the articulation along axes 501 and 305 (see e.g., FIG. 6) permit attachment of structural members 800 that are aligned at non-perpendicular angles both vertically and horizontally. That is, the fencing members 805 need not be perpendicular to each other to attach structural members 800 therebetween. In addition, rail mount 100 including the engaged first swivel assembly 105 and the second swivel assembly 109 preferably includes machined edges and sufficiently low profiles to provide asthetically pleasing junctions that do not interfere with or degrade structural or ornamental components that may be incorporated into the fencing system 801.

The present invention is not limited to the above configuration and may include alternate configurations of the rail mount 100 that allow rotation of the first swivel assembly 105 and the second swivel assembly 109 about independent axes. In addition, the components of the rail mount 100 and the fencing system 801 according to the present invention, including the swivel mount 103, the first swivel assembly 105, the second swivel assembly 109, the structural components 800 and the fencing members 805 are preferably fabricated from a fencing material such as, but not limited to, polyvinyl chloride (PVC) and acrylonitrile butadiene styrene (ABS) plastic. In addition, the components of the rail mount 100 and the fencing system 801 may be provided with one or more colors, either coated thereon or incorporated into the material. In addition, the configuration of the first swivel assembly 105 and the second swivel assembly 109 is not limited to the configuration shown and described above. For example, a plurality of pockets 113 may be utilized for connection to a plurality of structural members 800. In addition, the first swivel assembly 105 may be configured to receive a plurality of second swivel assembly 109. Likewise, swivel mount 103 may be configured to receive a plurality of first swivel assembly 105 or may be configured to permit rotation of barrel portion 303 about a plurality of axes. In addition, swivel mount 103 may be configured to be reconfigurable or rotatable with respect to fencing member 805 in order to provide greater ease and flexibility in installation.

While the above systems have been described with respect to fencing connectors and fencing systems. The connector of the present invention may be utilized in any structural system requiring joints between structural members and may include systems, such as decking systems, railing systems, or construction components having structural members to be joined at angles to each other.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A fence comprising:

a fencing connector connecting a rail to a fence post, said fencing connector comprising:

a swivel mount having a surface conformingly mounted to a side of said post and a cavity with at least one channel therein;

a first swivel assembly received within said cavity, said first swivel assembly having an attachment flange and a barrel portion, said barrel portion having at least one substantially cylindrical engagement feature, said engagement feature conformingly received within said at least one channel, respectively, such that said swivel assembly is rotatable with respect to said swivel mount about a first axis; and a second swivel assembly having a pocket receiving said rail and having an attachment portion, said attachment portion receiving said attachment flange therein to connect said second swivel assembly to said first swivel assembly pivotally about a second axis, said second axis being substantially perpendicular to said first axis; and wherein said connector allows for angular adjustment of said rail relative to said post about said first axis and said second axis.

2. The fence of claim 1, wherein the swivel mount, first swivel assembly, and second swivel assembly comprise a material selected from wood, vinyl, metal, composite, or combinations thereof.

3. The fence of claim 2, wherein the material is polyvinyl chloride or acrylonitrile butadiene styrene.

4. The fence of claim 1, wherein the rail has a cross-sectional geometry selected from the group consisting of rectangular cross-sections, triangular cross-sections, square cross-sections, oval cross-sections, circular cross-sections, mushroom cross-sections, bread-bun cross-sections, and "T" rail cross-sections.

5. The fence of claim 1, wherein the swivel mount further includes an opening configured to receive a fastener.

6. The fence of claim 1, wherein the swivel mount further includes a channel configured to engage a feature of the first swivel assembly to constrain rotation of the first swivel assembly about the first axis.

7. The fence of claim 1, wherein the first swivel assembly and second swivel assembly comprise an opening configured to receive a pivoting member to constrain rotation of the second swivel assembly about the second axis.

8. The fence of claim 7, wherein the pivoting member is selected from the group consisting of a pin, a bolt, a rivet, a screw, and a rod.

9. The fence of claim 1, wherein the rail is a deck rail.

10. The fence of claim 1, wherein the rail is a handrail for a stairway.

11. The fence of claim 1, wherein the rail is a fence rail.

12. The fence of claim 1, wherein the rail is at a non-perpendicular angle to the fence post.

* * * * *